US009657986B2

(12) United States Patent
Bernhardt et al.

(10) Patent No.: US 9,657,986 B2
(45) Date of Patent: May 23, 2017

(54) INSTALLATION AND METHOD FOR PRODUCING LIQUID HELIUM

(75) Inventors: Jean-Marc Bernhardt, La Buisse (FR); David Grillot, Rives (FR); Veronique Grabie, Coublevie (FR); Eric Fauve, Venelles (FR); Michel Bonneton, Le Puy Sainte Reparade (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 611 days.

(21) Appl. No.: 13/980,178

(22) PCT Filed: Jan. 12, 2012

(86) PCT No.: PCT/FR2012/050079

§ 371 (c)(1),
(2), (4) Date: Jul. 17, 2013

(87) PCT Pub. No.: WO2012/098326

PCT Pub. Date: Jul. 26, 2012

(65) Prior Publication Data

US 2013/0291585 A1 Nov. 7, 2013

(30) Foreign Application Priority Data

Jan. 19, 2011 (FR) ..... 11 50416

(51) Int. Cl.
*F25J 1/00* (2006.01)
*F25J 1/02* (2006.01)

(52) U.S. Cl.
CPC ..... *F25J 1/0007* (2013.01); *F25J 1/004* (2013.01); *F25J 1/0037* (2013.01); *F25J 1/0202* (2013.01);
(Continued)

(58) Field of Classification Search
CPC ..... F25J 1/0007; F25J 1/0035; F25J 1/0037; F25J 1/0065; F25J 1/0201; F25J 1/0275;
(Continued)

(56) References Cited

U.S. PATENT DOCUMENTS 5,144,806 A * 9/1992 Frenzel et al. ..... 62/639
5,505,232 A * 4/1996 Barclay ..... 141/11
(Continued)

FOREIGN PATENT DOCUMENTS

DE 10 2008 007923 8/2009
EP 0 520 937 12/1992
(Continued)

OTHER PUBLICATIONS

Translation of EP 0520937 A1.*
(Continued)

*Primary Examiner* — Frantz Jules
*Assistant Examiner* — Brian King
(74) *Attorney, Agent, or Firm* — Christopher J. Cronin

(57) ABSTRACT

The invention relates to a method and an installation for producing liquid helium, said installation comprising a cooling/liquefaction device comprising a working circuit that subjects a helium-enriched working fluid to a thermodynamic cycle in order to produce liquid helium, said circuit comprising at least one working fluid compression body and a plurality of heat exchangers. The installation also comprises a plurality of fluid recovery lines having respective upstream ends to be selectively connected to respective reservoirs, and a first collection line having an upstream end connected to the recovery lines and a downstream end connected to a receiving body that can supply the working circuit with a working fluid. The installation is characterized in that it comprises at least one second and one third collection line that each have an upstream end connected to
(Continued)

the recovery lines and a downstream end connected to the working circuit, the upstream ends of the second and third collection lines being connected at separate determined positions of the working circuit, that respectively correspond to separate temperature levels of the working fluid in the working circuit.

12 Claims, 1 Drawing Sheet

(52) U.S. Cl.
CPC ..... *F25J 1/0247* (2013.01); *F25J 1/0271* (2013.01); *F25J 1/0275* (2013.01); *F25J 2210/02* (2013.01); *F25J 2220/02* (2013.01); *F25J 2245/90* (2013.01); *F25J 2270/06* (2013.01); *F25J 2290/60* (2013.01); *F25J 2290/62* (2013.01)

(58) Field of Classification Search
CPC .. F25J 2210/02; F25J 2210/04; F25J 2210/06; F25J 2215/30; F25J 2220/02; F25J 2270/20; F25J 2270/04; F25J 2270/06; F25J 2290/12; F25J 2290/50; F25J 2290/60; F25J 2290/62; F25J 1/0271; F25J 1/0202; F25J 1/0247; F25J 1/0254; F25J 2245/90; F25J 1/0262; F25J 1/0045; F17C 5/04; F17C 2221/017; F17C 5/007; F25B 9/10
USPC ..... 62/608, 53.2, 50.7, 657, 48.3, 48.2, 48.1
See application file for complete search history.

(56) References Cited

U.S. PATENT DOCUMENTS

| | | | | |
|---|---|---|---|---|
| 7,762,082 | B1 * | 7/2010 | Knight | F02C 1/02 60/39.091 |
| 2009/0199579 | A1 * | 8/2009 | Kundig | F25J 1/0007 62/115 |
| 2010/0281888 | A1 * | 11/2010 | Kundig | H01F 6/04 62/65 |

FOREIGN PATENT DOCUMENTS

| | | | | |
|---|---|---|---|---|
| EP | 0520937 | A1 * | 12/1992 | B01D 5/0039 |
| FR | 2 662 786 | | 12/1991 | |
| FR | 2 919 716 | | 2/2009 | |
| JP | 02 056 213 | | 2/1990 | |
| JP | 05223381 | A * | 8/1993 | |
| JP | 11125474 | A * | 5/1999 | |

OTHER PUBLICATIONS

Translation of JP 11125474 A.*
EP0520937A1 Translation.*
International Search Report and Written Opinion for PCT/FR2012/050079, mailed Jun. 26, 2013.
French Search Report for FR 1 150 416, mailed Nov. 3, 2011.
Choi, et al., "Helium refrigeration system for the KSTAR," Fusion Engineering and Design, Elsevier Science Publishers, Amsterdam, NL, vol. 81, No. 23-24, Nov. 1, 2006, pp. 2623-2631.

* cited by examiner

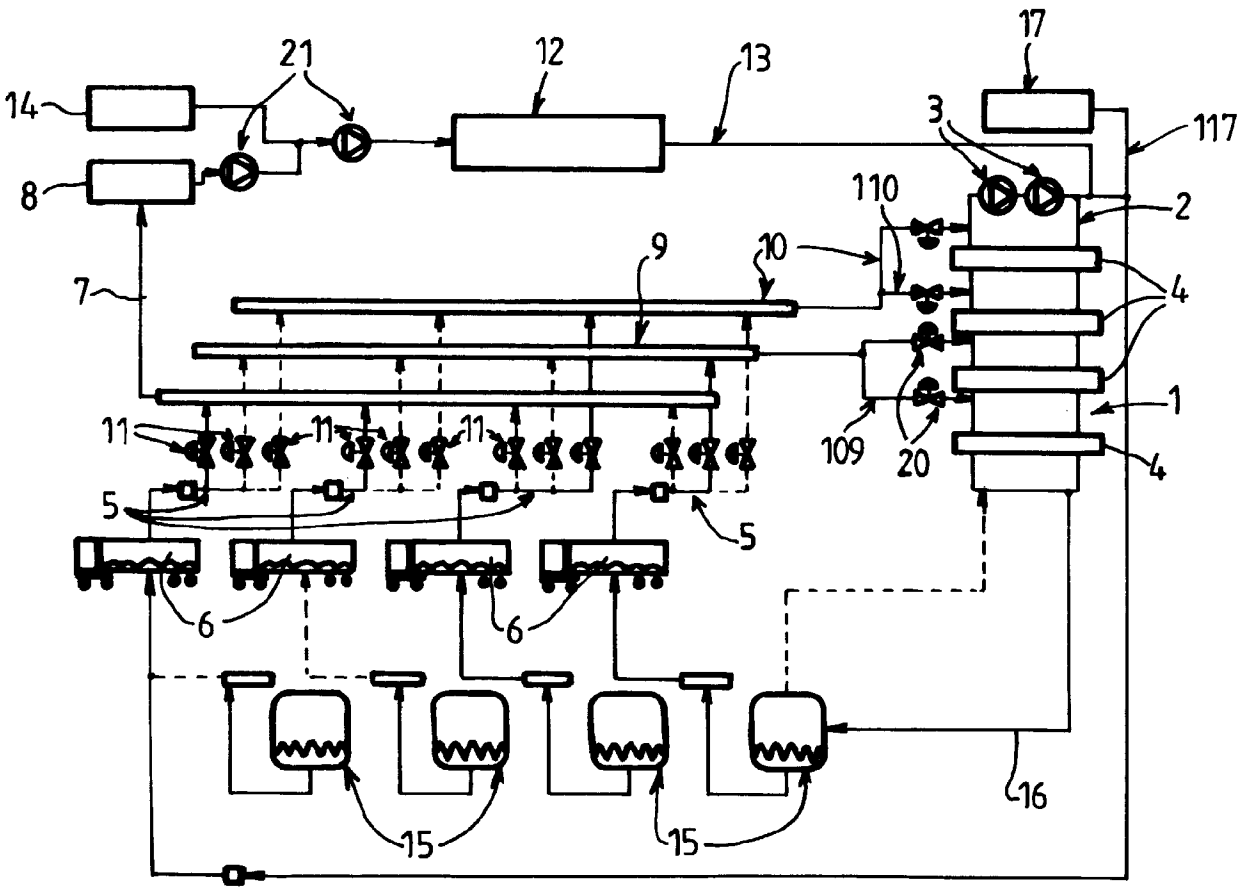
117
17
2
4
1
4
3
16
110
20
109
13
10
5
9
15
12
6
11
21
15
11
6
14
8
7
11
5

INSTALLATION AND METHOD FOR PRODUCING LIQUID HELIUM

CROSS-REFERENCE TO RELATED APPLICATIONS

This application is a §371 of International PCT Application PCT/FR2012/050079, filed Jan. 12, 2012, which claims §119(a) foreign priority to French patent application 1150416, filed Jan. 19, 2011.

BACKGROUND

Field of the Invention

The present invention relates to a plant and a process for the production of helium.

The invention relates more particularly to a plant for the production of liquid helium comprising a refrigeration/liquefaction device, the refrigeration/liquefaction device comprising a working circuit in which a working fluid enriched in helium is subjected to a thermodynamic cycle in order to produce liquid helium, the circuit comprising at least one means for compressing the working fluid and several heat exchangers in order to cool/reheat the fluid to predetermined temperature levels during the cycle, the plant comprising several pipes for recovery of fluid having respective upstream ends intended to be selectively joined to respective tanks in order to transfer fluid from the tanks to the refrigeration/liquefaction device, the plant comprising a first collecting pipe having an upstream end connected to the recovery pipes and a downstream end connected to a receiving means capable of feeding the working circuit with working fluid.

The invention relates in particular to the production and distribution of liquid helium. Helium, a noble gas, is generally obtained from natural gas in plants where natural gas is purified (enriched in helium) and then liquefied in a refrigerating and/or liquefying device.

Related Art

The distribution of helium generally requires cooling of the helium to a temperature of below 4.5K (liquid state) and then its transportation and its distribution in mobile tanks, for example on semitrailers. These tanks, which can be isolated with nitrogen, generally have to be maintained at a temperature not exceeding 50 to 60K. For this reason, it is not recommended to completely empty these tanks of their helium.

In practice, after delivery, these "emptied" tanks return to the filling points at temperatures of the order of 150K and more. Thus, when the tank returns after delivery from the client and before filling it with helium, it is necessary to cool it to 4.5K as, if not, the liquid helium introduced would evaporate.

Generally, the contents remaining in these tanks are reinjected into the helium production plant in order to prevent losses of this expensive gas.

The tanks are usually cooled in the filling points by circulating (in a loop) helium from the point through the tank to be cooled in order thus to lower the temperature thereof.

Due to the potential evaporations, it is sometimes necessary to purify this gas and to reliquify it.

This recovery of relatively warm gas, its possible purification and its liquefaction require the consumption of a great deal of energy.

In addition, the gaseous helium possibly produced during the cooling may exceed the capacity of the helium liquefaction plants with which the plant is equipped.

For some helium liquefiers and/or refrigerators, the "warm" gases returned from the tanks (that is to say, at a temperature greater than the liquid nominal production temperature) are sent to the refrigerator/liquefier at different levels in the refrigerator/liquefier. For example, these recovered warm gases are reinjected at predetermined places in the working circuit of the refrigeration/liquefaction device between the "cold" and "warm" ends, that is to say at predetermined temperature levels of the helium in the working circuit.

Furthermore, when the fluid present in the tanks exhibits a high content of impurities, it is necessary to purify it beforehand in the recovery and purification system of the plant.

Thus, the fluid from the different tanks is either sent into the recovery and purification system of the plant (when it exhibits impurities) or is collected in a common collector before being injected into the working circuit of the liquefier/refrigerator (when the fluid is relatively pure). This mixture of pure fluids collected in the various tanks concerned is sent into the working circuit at a pressure/temperature level corresponding to the temperature level of the mixture of fluids.

These known processes require the consumption of a great deal of energy in order to provide for the production of liquid helium while recovering the more or less warm fluids originating from the empty tanks.

SUMMARY OF THE INVENTION

One aim of the present invention is to overcome all or some of the disadvantages of the prior art picked out above.

To this end, the plant according to the invention, furthermore in accordance with the generic definition which the above preamble gives thereof, is essentially characterized in that it comprises at least one second collecting pipe and one third collecting pipe, each having an upstream end connected to the recovery pipes and a downstream end connected to the working circuit, the downstream ends of the second collecting pipe and third collecting pipe being joined to predetermined separate positions of the working circuit respectively corresponding to temperature separate levels of the working fluid in the working circuit.

In this way, by suppressing the mixing of the pure fluids before injection into the working circuit of the refrigerator/liquefier, the Applicant Company has observed a significant increase in the energy efficiency of the plant.

This is because the vapors which return from the various tanks are not necessarily at the same temperatures and their mixing results in a mean temperature. The graduated recovery of the "clean" (pure) vapors according to their temperature makes it possible to make the best possible use of the cold energy conveyed by the recovered fluid.

Furthermore, embodiments of the invention can comprise one or more of the following characteristics:

- at least the downstream end of one of the collecting pipes comprises a branch circuit so that the collecting pipe concerned can be selectively joined to at least two predetermined separate positions of the working circuit respectively corresponding to separate temperature levels of the working fluid in the working circuit,
- the recovery pipes each comprise an upstream end which can be joined to a tank and a plurality of downstream ends connected in parallel to the upstream end, said downstream ends being respectively joined to the different collecting pipes, the downstream ends of the recovery pipes being equipped with respective valves for distributing the fluid from the tank selectively to the collecting pipe or pipes, the plant comprises a pipe for feeding with working fluid having an upstream end joined to at least one source of fluid and a downstream end joined to the working circuit, the feed pipe comprising at least one purification means for enriching in helium the fluid originating from the source or sources, in order to feed the circuit with a working fluid enriched in helium, the receiving means being positioned upstream of the purification means and constituting a source of fluid, the plant comprises a pipe for supplying liquid helium having an upstream end connected to the working circuit and at least one downstream end selectively connected to at least one storage facility intended to selectively feed at least one tank with liquid helium, the plant comprises a buffer tank selectively joined to the working circuit in order to store working fluid, the buffer tank being additionally joined to a purging pipe which can be selectively connected to at least one tank.

The invention also relates to a process for the production of liquid helium using a plant comprising a refrigeration/liquefaction device, the refrigeration/liquefaction device comprising a working circuit in which a working fluid enriched in helium is subjected to a thermodynamic cycle in order to produce liquid helium, the circuit comprising at least one means for compressing the working fluid and several heat exchangers in order to cool/reheat the fluid to predetermined temperature levels during the cycle, the plant comprising several recovery pipes having respective upstream ends intended to be selectively joined to respective tanks in order to transfer fluid from the tanks to the circuit, the process comprising:

a stage of joining several tanks at the upstream ends of respective recovery pipes, a stage of transfer of the fluid present in the tanks to the refrigeration/liquefaction device, the process being characterized in that: the fluids of the various tanks are transferred independently of one another into the working circuit at respective temperature levels determined as a function of the respective temperatures of the fluid in the tanks under consideration.

According to other possible distinguishing features:

the plant comprising a pipe for feeding with working fluid having an upstream end joined to at least one source of fluid and a downstream end joined to the working circuit, the feed pipe comprising at least one purification means for enriching in helium the fluid originating from the at least one source and feeding the circuit with a working fluid enriched in helium, when the fluid of one or more tanks exhibits a concentration of impurities which is greater than a threshold, the contents of the tanks concerned being transferred to a source, upstream of the purification means, when the fluid of one or more tanks exhibits a helium concentration which is lower than a threshold, the contents of the tanks under consideration are transferred to a source, upstream of the purification means, and, when the fluid of one or more tanks exhibits a temperature which is greater than a first predetermined threshold, the contents of the tanks under consideration are transferred at at least one first position of the working circuit corresponding to first temperature levels, when the fluid of one or more tanks exhibits a temperature which is lower than said first predetermined threshold, the contents of the tanks under consideration being transferred at at least one second position of the working circuit corresponding to second temperature levels, when the fluid of one or more tanks exhibits a helium concentration which is lower than a threshold, the contents of the tanks under consideration are transferred to a source, upstream of the purification means, and, when the fluid of one or more tanks exhibits a temperature which is greater than a first predetermined threshold, the contents of the tanks under consideration are transferred at at least one first position of the working circuit corresponding to first temperature levels, when the fluid of one or more tanks exhibits a temperature which is lower than said first predetermined threshold, the contents of the tanks under consideration being transferred at at least one second position of the working circuit corresponding to second temperature levels, the stage of transfer of the fluid present in a tank (6) to the plant comprises at least one from:

a stage of depressurization of the tank by transfer of the pressurized gas present in the tank to the plant, a stage of cooling the contents of said tank by circulation of helium originating from the refrigeration/liquefaction device to the tank and then return of this helium to the refrigeration/liquefaction device, a stage of filling the cooled tank with helium originating from the refrigeration/liquefaction device.

The invention can also relate to any alternative device or any alternative process comprising any combination of the above or following characteristics.

BRIEF DESCRIPTION OF THE FIGURES

FIG. 1 illustrates the plant and process of the invention.

DETAILED DESCRIPTION OF THE INVENTION

Other distinguishing features and advantages will become apparent on reading the description below, made with reference to the single FIGURE, which represents a diagrammatic and partial view illustrating the structure and the operation of a plant according to an implementational example of the invention.

The plant for the production of liquid helium represented in the FIGURE conventionally comprises a refrigeration/liquefaction device 1, that is to say an apparatus capable of refrigerating and/or liquefying helium at a very low temperature, for example down to 4 to 5K or below.

The refrigeration/liquefaction device 1 thus comprising a working circuit 2 in which a working fluid enriched in helium is subjected to a thermodynamic cycle in order to produce liquid helium. To this end, the working circuit 2 comprises at least one means 3 for compressing the working fluid, such as compressors, and several heat exchangers 4 in order to cool/reheat the fluid to predetermined temperature levels during the cycle.

The working circuit 2 can also conventionally comprise one or more means for reducing the fluid in pressure, such as turbines (not represented for reasons of simplicity).

The working fluid (generally helium) thus undergoes a cycle in the working circuit between a warm end (compression) and a cold end where it is liquefied (by reduction in pressure and cooling).

In order to recover the fluid remaining in the delivery return tanks 6, the plant comprises several pipes 5 for recovery of fluid.

Each pipe 5 for recovery of fluid comprises an upstream end intended to be selectively joined to a tank 6 or a fluid inlet.

The plant also comprises a first fluid-collecting pipe 7 having an upstream end connected to the recovery pipes 5 and a downstream end connected to a receiving means 8 capable of storing gas for the purpose of feeding the working circuit 2 with working fluid.

The plant comprises a second collecting pipe 9 and a third collecting pipe 10 each having an upstream end connected to the recovery pipes 5.

The downstream end of the second collecting pipe 9 is joined to a predetermined position of the working circuit 2 respectively corresponding to a first predetermined temperature level of the working fluid in the working circuit 2.

The downstream end of the third collecting pipe 10 is joined to a predetermined position of the working circuit 2 respectively corresponding to a second predetermined temperature level of the working fluid in the working circuit 2.

For example, the downstream end of the third collecting pipe 10 is joined to the working circuit 2 at a relatively warmer place of the working circuit 2 than the downstream end of the second collecting pipe 9.

That is to say that the second collecting pipe 9 and a third collecting pipe 10 are joined in fluid terms to separate places of the working cycle, that is to say to places of the working circuit 2 where the working fluid exhibits different thermodynamic conditions, in particular in terms of temperature.

The contents of each tank 6 can be selectively joined either to the receiving means 8 or to the second collecting pipe 9 or to the third collecting pipe 10.

Thus, the contents of each tank 6 can be joined, independently of the other tanks 6, to separate levels of the working circuit 2 and in particular to a cycle temperature level suited to the temperature of the fluid of the tank 6. That is to say that, when the fluid of the tank 6 is more or less "warm", it is reinjected at more or less warm levels of the working circuit 2 in order to disrupt as little as possible the efficiency of said working circuit 2.

As represented, the downstream end of the second and third collecting pipes 9, 10 can comprise branch circuits 110, 109, so that each collecting pipe 9, 10 concerned can be selectively joined to several predetermined separate positions of the working circuit 2. In this way, the plant makes it possible to multiply the possibilities of injection into the working circuit 2 (and thus to multiply the temperature levels of the cycle). To this end, the second and third collecting pipes 9, 10 can comprise respective distribution valves.

Likewise, the recovery pipes 5 each comprise an upstream end which can be joined to a tank 6 and a plurality of downstream ends connected in parallel to the upstream end. The downstream ends of each recovery pipe 5 are respectively joined to the different collecting pipes 7, 9, 10, for example via respective valves 11.

As represented, the working circuit 2 can be fed with a working fluid enriched in helium via a pipe 13 for feeding with working fluid having an upstream end joined to at least one source 8, 14 of fluid and a downstream end joined to the working circuit 2. Downstream of the sources 8, 14, the feed pipe 13 can comprise at least one purification means 12 for enriching in helium the fluid originating from the source or sources 8, 14. A source 14 can comprise, for example, a feed of treated natural gas. Another source 8 can, for example, store the impure gas recovered from the tanks 6 via the first collecting pipe 7. The gas originating from one or both sources 8, 14 can be compressed (compressors 21) and then purified in the purification means 12 (for example of the adsorption type) in order to feed the working circuit 2 with helium.

In order to provide for the prior purging of the tanks 6 before they are cooled and filled, the plant can comprise a buffer tank 17 selectively joined to the working circuit 2 in order to store working fluid originating from the compression station (warm end of the working circuit 2). This buffer tank 17 is connected to a purging pipe 117 which can be selectively connected to at least one tank 6 (in the FIGURE, the first left-hand tank being in the purging situation).

In order to provide for the cooling and the filling of the tanks 6 with cold liquid helium (4 to 5K, for example), the plant can also comprise a pipe 16 for supplying liquid helium having an upstream end connected to the cold end of the working circuit 2 and at least one downstream end selectively connected to at least one storage facility 15. The liquid storage facilities 15 are intended to feed the tank or tanks 6 with liquid helium. In the FIGURE, the third tank 6 (from left to right) is represented diagrammatically in the cooling situation: helium is moved from a storage facility 15 to the tank 6 and then this helium is reinjected into the working circuit via the third collecting pipe 10 (at a relatively "warm" temperature level, cf. the arrows with solid lines).

In the FIGURE, the fourth tank 6 (from left to right) is represented diagrammatically in the filling situation: a loop for circulation of helium is produced from the working circuit 2 to the storage facility 15 and then to the tank 6 (cf. the arrows with solid lines). The excess helium from the tank 6 is reinjected into the working circuit via the second collecting pipe 9 (at a relatively "cold" temperature level).

In the FIGURE, the second tank 6 (from left to right) is represented diagrammatically in the situation of transfer of the gas from the tank 6 to the source 8 via the first collecting pipe 7 (cf. the arrows with solid lines).

The plant according to the invention thus makes it possible to selectively and independently connect the vapors present in the "empty" tanks 6 to three collecting pipes:

- the first 7 for directing the impure and relatively warm vapors upstream of the purification means 12,
- the second 9 for directing the relatively cold pure vapors to a relatively cold region of the working circuit 2 for the purpose of the reliquefaction of these vapors,
- the third 10 for directing the relatively warm pure vapors to a relatively warm region of the working circuit 2 for the purpose of the reliquefaction of these vapors.

This dividing up of the vapors is carried out as a function of the nature and in particular of the temperature of the vapors present in each of the tanks 6.

The Applicant Company has found that, by independently treating the various contents of the tanks 6 (without mixing between the contents of tanks 6 at separate temperatures before injection into the working circuit 2), makes it possible to optimize the recoveries of frigories from the vapors in the refrigeration/liquefaction device. This improves the effectiveness of the latter and in particular its efficiency from the viewpoint of its energy consumption.

Of course, the invention is not limited to the example described above. Thus, for example, the number of the recovery pipes 5 which can be connected to tanks 6 is not limited to four but can be less than or greater than four.

Likewise, the number of collecting pipes can be less than or greater than the number of pipes 7, 9, 10 described above.

Likewise, the vapors recovered from the tanks can originate from stationary applications which use liquid helium for cooling (for example for the cooling of superconducting cables). In this case, one or more mobile tanks 6 of the FIGURE is/are replaced by a fluid connection which brings back helium which has exchanged thermally with an application to be cooled.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially " of and "consisting of"; "comprising" may therefore be replaced by "consisting essentially of" or "consisting"of and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A plant for the production of liquid helium comprising:

a refrigeration/liquefaction device, the refrigeration/liquefaction device comprising a working circuit in which a working fluid enriched in helium is subjected to a thermodynamic cycle in order to produce liquid helium, the circuit comprising at least one compressor to compress the working fluid and several heat exchangers in order to cool/reheat the fluid to predetermined temperature levels during the cycle;

several recovery pipes for recovery of fluid having respective upstream ends which can be selectively joined to respective tanks which are mobile in order to transfer fluid from the tanks to the refrigeration/liquefaction device so that the working circuit is of the open type and selectively collects fluid external to the circuit at the recovery pipes;

a first collecting pipe having an upstream end connected to the recovery pipes and a downstream end connected to a fluid storage device capable of feeding the working circuit with working fluid;

at least one second collecting pipe; and at least one third collecting pipe, each of the at least one second and at least one third collecting pipes having an upstream end connected to the recovery pipes and a downstream end connected to the working circuit, the downstream ends of the second collecting pipe(s) and third collecting pipe(s) being joined to predetermined separate positions of the working circuit respectively corresponding to separate temperature levels of the working fluid in the working circuit.

2. The plant of claim 1, wherein at least the downstream end of one of the collecting pipes comprises a branch circuit so that the collecting pipe concerned can be selectively joined to at least two predetermined separate positions of the working circuit respectively corresponding to separate temperature levels of the working fluid in the working circuit.

3. The plant of claim 1, wherein the recovery pipes each comprise an upstream end which can be joined to a respective tank and a plurality of downstream ends joined in parallel to the upstream end, said downstream ends being respectively joined to the different collecting pipes, the downstream ends of the recovery pipes being equipped with respective valves for distributing the fluid from the tank selectively to the collecting pipe or pipes.

4. The plant of claim 1, further comprising a feed pipe for feeding with working fluid having an upstream end joined to at least one source of fluid and a downstream end joined to the working circuit, the feed pipe comprising at least one purification unit for enriching in helium the fluid originating from the source or sources in order to feed the circuit with a working fluid enriched in helium, the fluid storage device being positioned upstream of the purifier and constituting one of the at least one source of fluid.

5. The plant of claim 1, further comprising a supply pipe for supplying liquid helium having an upstream end connected to the working circuit and at least one downstream end selectively connected to at least one storage facility selectively feeding at least one tank with liquid helium.

6. The plant of claim 1, further comprising a buffer tank selectively joined to the working circuit in order to store working fluid, the buffer tank being additionally joined to a purging pipe which can be selectively connected to at least one tank.

7. The plant of claim 1, wherein the mobile tanks are on semitrailers.

8. A process for the production of liquid helium with a plant comprising a refrigeration/liquefaction device, comprising the steps of:

joining upstream ends of several recovery pipes to a respective several mobile tanks each of which contains fluid enriched in helium;

transferring the fluids enriched in helium from the mobile tanks to the refrigeration/liquefaction device; and refrigerating and liquefying gaseous helium with the refrigeration/liquefaction device comprising a working circuit in which a working fluid enriched in helium is subjected to a thermodynamic cycle in order to produce liquid helium, the circuit comprising at least one compressor which compresses the working fluid and several heat exchangers which cool/reheat the working fluid to predetermined temperature levels during the cycle, wherein the fluids from the mobile tanks are transferred independently of one another into the working circuit at separate positions of the working circuit respectively corresponding to the separate temperatures being transferred, the working circuit being of the open type because fluid external to the working circuit is collected by the recovery pipes.

9. The process of claim 8, wherein:

the plant further comprises a feed pipe for feeding with working fluid having an upstream end joined to at least one source of fluid and a downstream end joined to the working circuit, the feed pipe comprising at least one purifier for enriching in helium the fluid originating from the at least one source and feeding the circuit with a working fluid enriched in helium; and when the fluid(s) of one or more tanks exhibits a concentration of impurities which is greater than a threshold concentration, such fluid(s) is transferred to a source upstream of the purification means.

10. The process of claim 9, wherein:

when the fluid from one of the tanks exhibits a helium concentration which is lower than a threshold, such fluid is transferred to a source upstream of the purification means;

when the fluid of one of the tanks exhibits a first temperature which is greater than a first predetermined threshold, such fluid is transferred to a first position of the working circuit corresponding to the first temperature; and when the fluid from one of the tanks exhibits a second temperature which is lower than said first predetermined threshold, such fluid is transferred to a second position of the working circuit corresponding to the second temperature.

11. The process of claim 8, wherein the fluid enriched in helium, that is present in the tank from which fluid enriched in helium is being transferred out of, is cooled by addition of helium from the refrigeration/liquefaction device to the tank that is simultaneous with performance of said step of transferring the fluid enriched in helium.

12. The process of claim 11, wherein the tank containing the cooled fluid is filled with helium from the refrigeration/liquefaction device.

* * * * *